US006960710B2

(12) United States Patent
Segan et al.

(10) Patent No.: US 6,960,710 B2
(45) Date of Patent: Nov. 1, 2005

(54) ELECTRONIC ACOUSTIC MUSIC ENGINE

(75) Inventors: Marc Howard Segan, New York, NY (US); Gary Strauss, Mamaroneck, NY (US); Leo Fernekes, New York, NY (US)

(73) Assignee: M.H. Segan Limited Partnership, Great Barrington, MA (US)

( * ) Notice: Subject to any disclaimer, the term of this patent is extended or adjusted under 35 U.S.C. 154(b) by 0 days.

(21) Appl. No.: 10/817,307

(22) Filed: Apr. 2, 2004

(65) Prior Publication Data

US 2004/0231486 A1 Nov. 25, 2004

Related U.S. Application Data

(60) Provisional application No. 60/460,508, filed on Apr. 4, 2003, and provisional application No. 60/461,199, filed on Apr. 8, 2003.

(51) Int. Cl.[7] ..... G10F 1/06
(52) U.S. Cl. ..... 84/94.1
(58) Field of Search ..... 84/94.1–95.2

(56) References Cited

U.S. PATENT DOCUMENTS 5,142,961 A * 9/1992 Paroutaud ..... 84/726
5,315,060 A * 5/1994 Paroutaud ..... 84/726

* cited by examiner

*Primary Examiner*—Jeffrey W Donels
(74) *Attorney, Agent, or Firm*—Cohen, Pontani, Lieberman & Pavane

(57) ABSTRACT

An electronic engine for generating acoustic musical notes for simulating a music box. The engine includes a memory for storing data, and an electronic controller connected to the memory for producing a control signal in accordance with said data. A plurality of tone generating members, such as tines from a comb are provided, with each tine generating a corresponding musical note when the tine is placed in motion. One or more actuators in communication with the controller generate a temporary magnetic field in response to the control signal for resonantly adding energy to the tines without requiring physical contact between the tines and the actuators to produce the corresponding musical notes.

36 Claims, 9 Drawing Sheets

ELECTRONIC ACOUSTIC MUSIC ENGINE

RELATED APPLICATIONS

This application claims priority from U.S. Provisional Patent Application Ser. No. 60/460,508 which was filed on Apr. 4, 2003 and U.S. Provisional Application Ser. No. 60/461,199 which was filed on Apr. 8, 2003.

BACKGROUND OF THE INVENTION

1. Field of the Invention

The present invention pertains to an acoustic music box and, more particularly, to an electronic digital acoustic music engine utilizing magnetic actuation to cause "plucking" of musical tines.

2. Description of the Related Art

Music Boxes have been around for hundreds of years. The pure and gentle sound of plucked metal tines resonating in a suitable surrounding box or sculpture is a warm and familiar experience for millions. Despite the recent revolutionary development of extremely inexpensive digital integrated circuits used to create music and sounds in all kinds of consumer products and toys, the old-fashioned music box persists. The sound is unique and still not trivial to duplicate inexpensively using other technology.

To produce that unmistakable sound, there have been many types and generations of mechanisms created over the years, but they all rely upon the same mechanical event to produce a tone: the plucking of a tuned metal tine by a passing pin or similar structure.

Apart from the sound, there has been more variety and inventiveness applied toward increasing the number of songs a music box can produce. Multiple tines tuned to different notes are typically contained on a "comb" positioned for contact with the passing pins. While many music box mechanisms operate by means of cylinders bristling with metal pins rotating adjacent to the tine comb, this has the significant disadvantages of limiting the song to the one cylinder as well as limiting the length of that song to the time it takes for the cylinder to rotate once fully around. Some mechanisms have employed replaceable cylinders, which solves the first problem, but not the second. Another variation employs replaceable metal or plastic disks having integrally-molded pins extending from a surface and positioned for contact with a tine comb. Such a system, however, has the exact same limitations as the replacement cylinders but whose disks are much cheaper to produce, insert or replace. Another variation employs a foldable length of punched paper tape driven past a plucking mechanism. This variation vastly increases the number of melodies or songs played, but requires that they be played in sequence as the length of punched paper traverses the plucking mechanism. This variation also requires the precise feeding of an end of the paper tape into the player—a somewhat cumbersome task—and also requires significant storage space for multiple tapes, e.g., retail storage space for stacking punched tapes containing various melodies, and user storage space for storing a plurality of purchased tapes. There have been other variations, too, that address these limitations in different ways, but usually more complicated, unreliable and excessively mechanical in nature.

More generally, most such mechanical systems are limited in their musical agility: an ability to produce multiple notes both simultaneously, sequentially and precisely in time. If a mechanism tries to pluck too many tines at once, it can become mechanically loaded and then stall, while the precision of note placement in time, for rapid "arpeggios" and scale runs is limited by the mechanical precision of pins or holes in disks or paper tape. In addition, such prior art mechanical music boxes do not provide for variations in volume of selected notes or other special articulation and accent effects. Specifically, because of the relative position between a pin and a corresponding tine, the pin will engage the tine at precisely the same way for every occurrence, thereby producing a consistent note volume. While this is desirable for most occasions, in some situations it would be preferred to have a technique for varying the volume of the plucked notes.

It is also recognized that a music box system can be readily developed using a solenoid-driven pin reconfiguration technique on a rotating drum to strike tines on a comb. Such a system will allow for the playing of multiple melodies as dictated by the pin configurations. However, such a system will suffer from many of the drawbacks of the prior art as well as additional drawbacks. For example, such a system will require a relatively large amount of power, be more costly to the consumer, will present a significant mechanical drain on the rotating drum and motor, have low reliability, and require excess precision in order to play the selected melodies.

SUMMARY OF THE INVENTION

The present invention is directed to an electronic engine for generating acoustic musical notes that effectively duplicate and elaborate the tones generated from a conventional mechanical music box having tines and a mechanical actuator, such as a drum containing a plurality of pins which are positioned proximate the tines to strike the tines in a predetermined order to play a melody. In accordance with one embodiment, the electronic engine includes a memory containing data corresponding to a melody to be played, an electronic controller for retrieving the memory-stored data and producing a control signal, and at least one tone generating member. The tone generating member produces a corresponding musical note upon being moved. An actuator is provided in communication with the controller for generating, in response to the control signal, a temporary magnetic field. The actuator is positioned sufficiently close to the tone generating member to attract or repel it without requiring physical contact between the tone generating member and the actuator at the commencement of the attraction or repulsion. The creation and then discontinuance of the magnetic field by the actuator causes the tone generating member to vibrate to produce a corresponding musical note. By activating a plurality of tone generating members in any one of a plurality of sequences, numerous melodies can be played.

In a preferred embodiment, the magnetic field causes an attraction force between the tone generating member and the actuator.

In another embodiment of the invention, a plurality of tone generating members are formed from a comb of adjacent tines, with each tine having a resonant frequency, and the temporary magnetic field used to impart motion to the tines is formed by applying to the actuator a series of pulses at a frequency approximating the resonant frequency of the "target" tine.

In yet another embodiment, the electronic engine is intended to be incorporated in a box or other housing to resemble a conventional mechanical music box.

In a further another embodiment, the present invention includes a plurality of light sources and, in particular, LED's which are activated by the control signal to synchronize specific LED's with specific actuators to increase user enjoyment of the electronic engine.

In still another embodiment, a method of generating acoustic musical notes is described. The method is performed by producing a control signal representative of a musical melody, providing a plurality of tone generating members, with each of the members generating a corresponding musical note upon imparting motion thereto, placing an actuator at a distance from the plurality of tone generating members, and generating in the actuator, and in response to the control signal, a temporary magnetic field. The generated magnetic field is of sufficient strength to attract or repel at least one of the tone generating members without requiring physical contact between the selected or "target" tone generating member and the actuator to produce a desired tone.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference numerals denote similar elements throughout the several views.

DETAILED DESCRIPTION OF THE PRESENTLY PREFERRED EMBODIMENTS

Figure 1:
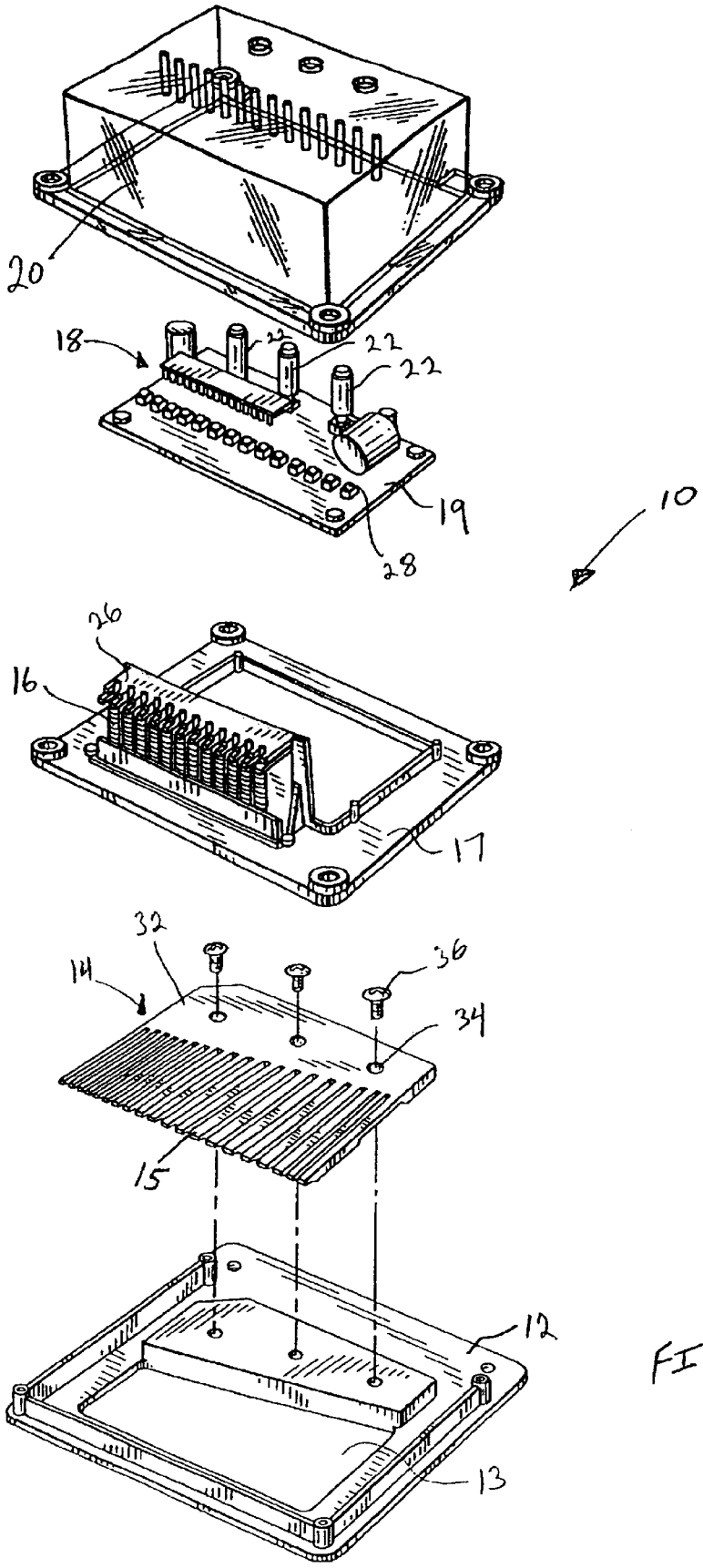
FIG. 1 depicts an exploded view of an electronic acoustic music engine.
Figure 2:
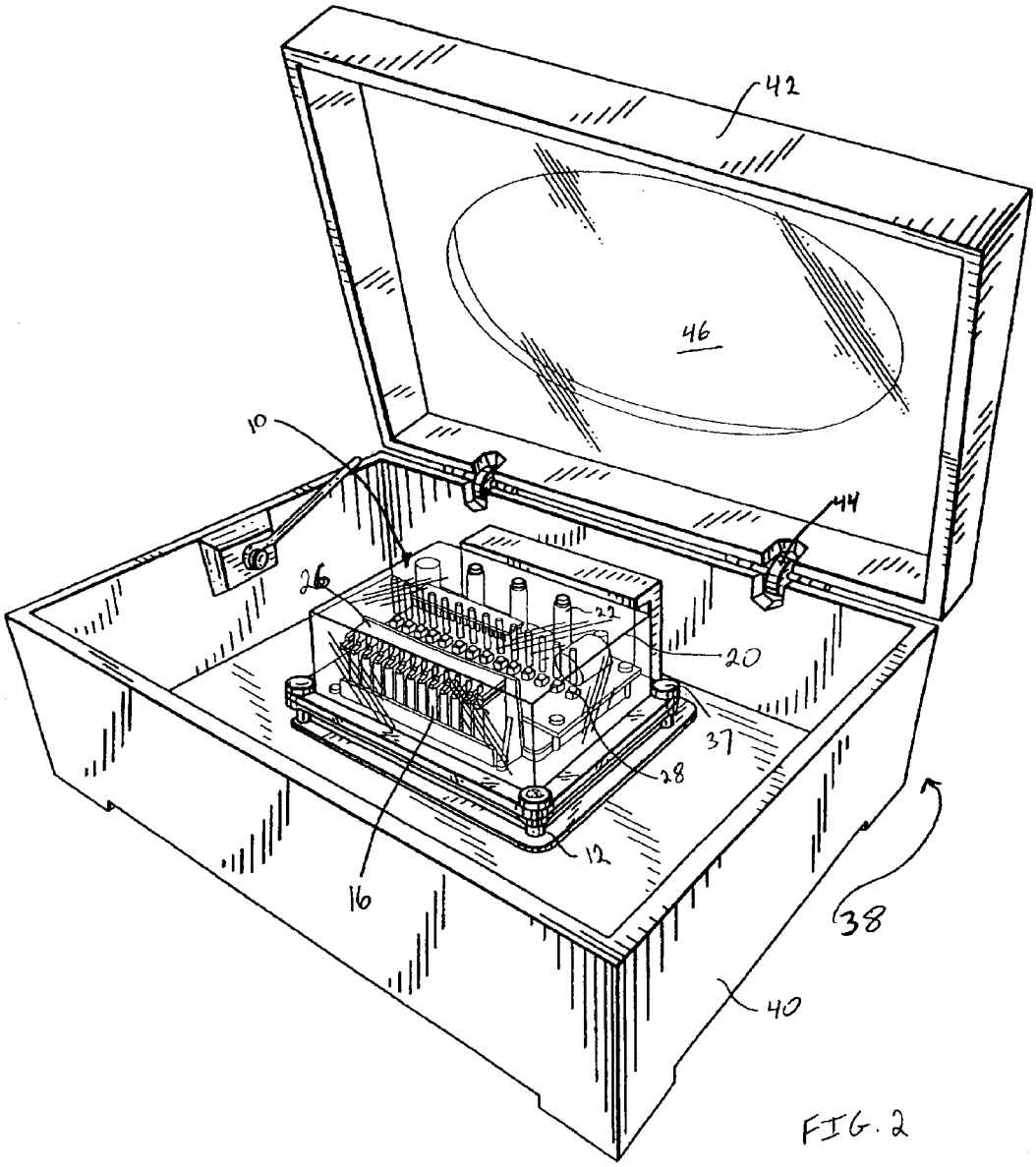
FIG. 2 depicts an assembled music engine within an outer housing.
Figure 3:
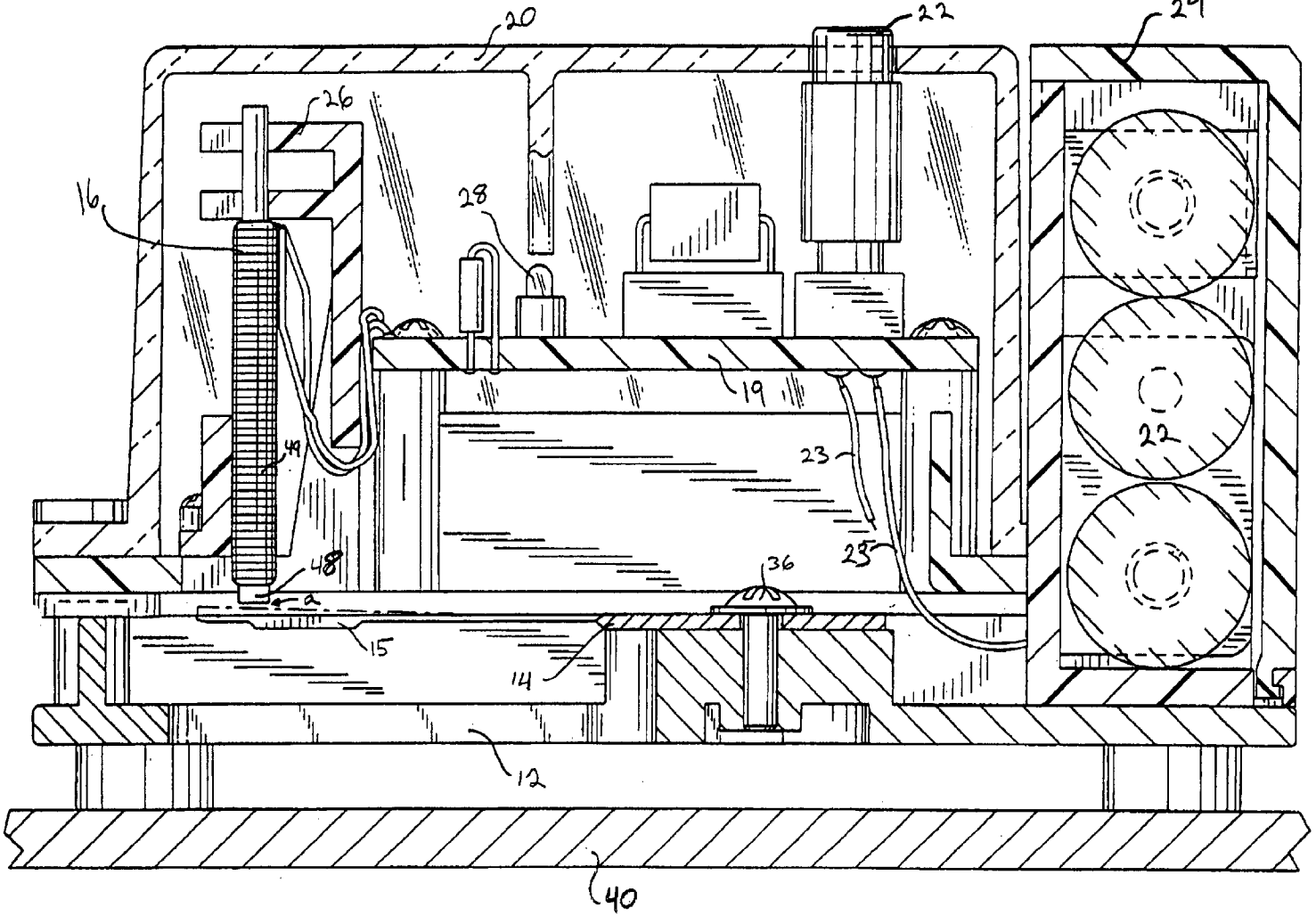
FIG. 3 depicts a cross-sectional right-side view of the music engine of FIG. 2 with the outer housing removed.

With reference to FIGS. 1–3 an electronic engine 10 for generating acoustic music notes is shown having a base plate 12, a comb 14 with a plurality of tines 15, a plurality of magnetic actuators 16 or "coils" and an electronic controller 18 including a circuit board 19 containing a digital control circuit for addressing and energizing one or more of the actuators 16. The device 10 includes one or more user interface controls 22 (also shown as SW1, SW2 and SW3 in FIG. 10*a*) such as pushbuttons, knobs, switches, sensors, etc., to allow user operation of the controller 18. The controller 18 may also be used to activate one or more visual effects such as LEDs 28 to enhance user enjoyment of the device 10 by providing audio as well as visual effects. The magnetic actuators 16 are mounted to a mounting bracket 26 affixed to a mounting plate 17 and positioned in opposing relation but-spaced from specific ones of the tines 15. The device 10 also includes an inner cover 20, preferably of molded plastic, to protect the various components. The cover is most preferably formed of a transparent material to allow visual inspection of the device during operation and to contribute to the dispersion of light generated from the LEDs 28. The engine 10 is preferably operable on battery power provided by one or more battery cells 22 connected to the circuit board 19 through a pair of wires 23. The batteries 22 are housed in the compartment concealed by a battery cover 24.

In general, when the device 10 is in operation, select ones of the magnetic actuators 16 are energized by the controller 18 for generating a magnetic attraction force in the selected actuators and thereby imparting movement to corresponding tines 15 disposed in close relation to the selected actuators. The tines are tuned to specific musical notes. The motion, in turn, causes the tines to generate musical tones corresponding to their associated notes. By imparting motion to individual or multiple tines in a particular order, various melodies or songs can be played.

The comb 14 used in the presently preferred embodiment is constructed of a ferrous material, and has an edge 32 in which one or more mounting holes 34 are formed for facilitating the mounting of the comb to the base plate 12 via fasteners, such as screws 36. The base plate 12 is preferably mounted, using appropriate fasteners 37, within an outer housing, box or other enclosure 38 constructed of wood, injection molded plastic, or other material particularly suited for sound resonation. The box includes a base 40 and a lid 42 connected by hinges 44 to the base and having a window 46 to allow user inspection of the device 10 while in operation. The base plate 12 has an opening 13 and a thickness to provide clearance above the housing floor for the individual tines when the tines are actuated to vibrate in their intended manner.

Figure 4:
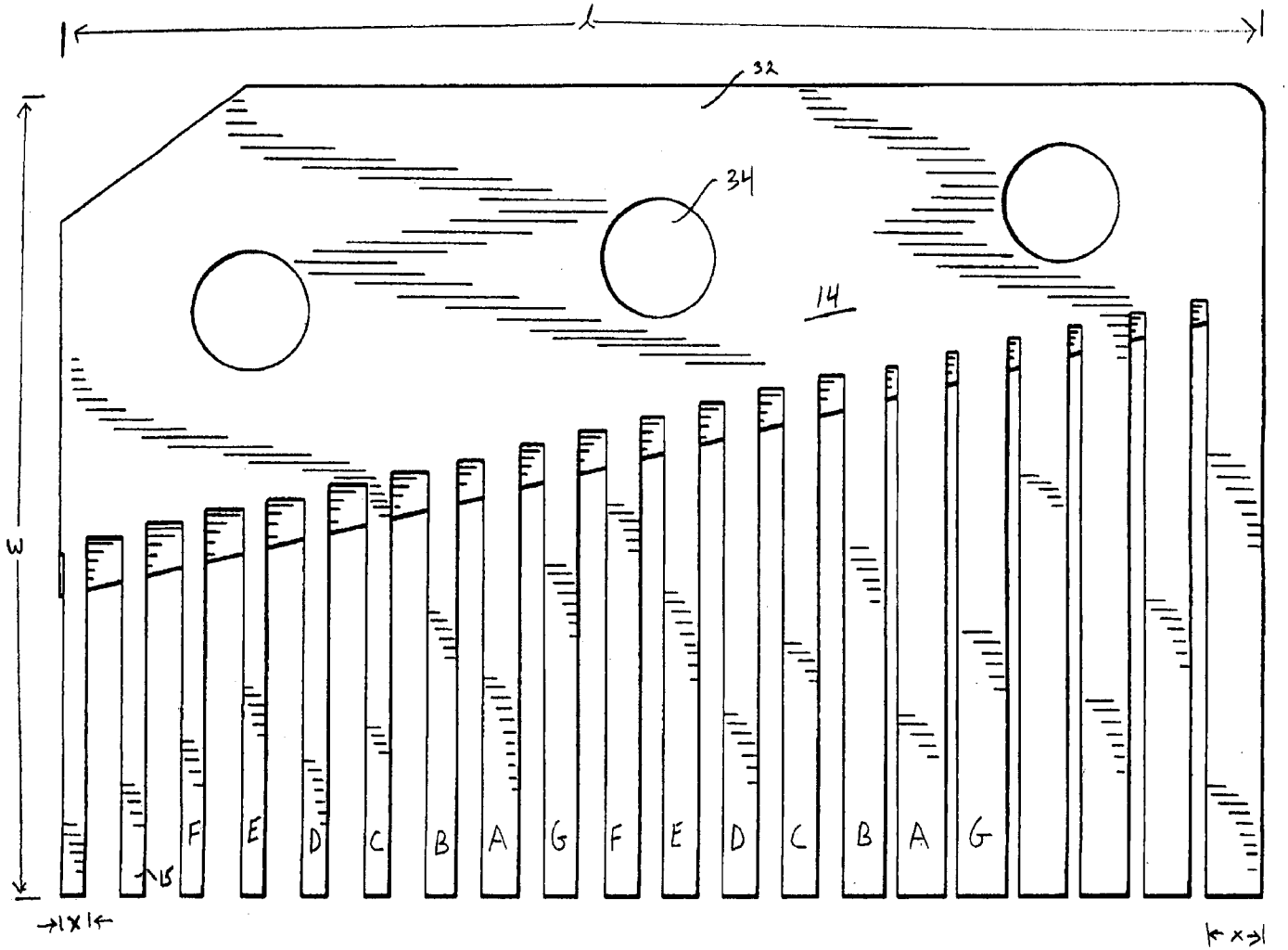
FIG. 4 shows a preferred tine comb for use in the present invention.

The preferred comb 14 is depicted in FIG. 4 and includes twenty closely-spaced tines in a side-by-side order arranged in the tuning of a diatonic scale. Not all of the tines need to be used to play melodies or songs and, in fact, it has been determined that the use of only fourteen of the twenty available tines, having a tuning of the notes, from low to high, G, A, B, C, D, E, F, G, A, B, C, D, E, F, produce suitable results. The overall comb has a length (l) of 2.342" and a width (w) of 1.53". The width (x) of the widest tine is 0.096" and that of the thinnest tine is 0.045". As shown, the tine lengths vary such that the tine length for the low "G" note is 1.034" and the tine length for the high "D" note is 0.682". Likewise, the tines are configured with varying thicknesses to produce the intended and desired notes. For example, the thickness of the most-narrow tine is 0.021". It will be appreciated that the thickness for each tine need not be consistent throughout the tine length and, in fact, the tines 15 in the preferred comb 14 have a thickest dimension proximate the tine free end as shown in FIG. 3. It will also be appreciated that the individual tines can be constructed in any manner, with any dimension (length, thickness, width) to result in desired note generation (i.e., tuning).

The present invention is not limited to any specific comb configuration, and various types of commercially available music box combs may be employed provided, however, that the combs are comprised of ferrous material to allow movement by magnetic force generated by the actuators 16 in accordance with the invention. Such commercially available combs all include a plurality of spaced tines which are tuned to specific musical notes by varying one or more of the tine width, length and thickness. The tines are typically arranged in ascending (or descending) musical order, but the use of other comb configurations and note arrangements will be readily recognizable to those of ordinary skill in the art.

The magnetic actuators 16 are spatially disposed proximate the tines 15 and, as explained above, are used to energize (e.g., to impart movement to) one or more of the tines at any given time. The actuators 16 are, in effect, electromagnets including a metal core 48 surrounded by a number of wire windings 49. (The terms "actuator" and "coil" are used interchangeably.) As is known in the art, by applying an electric current to the windings 49, a magnetic force is produced in the core 48. The magnetic force can then attract a magnetically-neutral object formed of a ferrous material, or repel a magnetically-charged object. In general, therefore, when an energized coil 16 is in a position proximate a tine 15 formed of a magnetically-neutral ferrous material, the generated magnetic force will attract the tine in the direction of the coil. The magnetic force can then be terminated by discontinuing the electric current applied to the coil. This will cause the tine to be released, thereby imparting a vibrating motion to the tine which generates a sound in accordance with the tine's tuned musical note.

To produce a desired music box tone, certain considerations need to be addressed. Specifically, the relative positions between the coils and tines are important, as is the strength of the magnetic force applied in order to move the tines and produce sound. As is known in the art, magnetic force between two objects is inversely related to the cube of the distance between those objects. Thus, a slight increase in a separation between the coils and tines will require a significant increase in the magnetic force and, hence, a larger current applied to the coil to move the tine in an intended manner. This, of course, will require more power—an undesirable result, especially if battery cells are utilized. An increased magnetic field may also produce an inadvertent movement of tines adjacent to the desired "target" tine which causes unwanted tone generation or "cross-talk" from tines adjacent to the target tine. Conversely, if the separation between a coil and a tine is too small, less current will be required. However, there may be insufficient clearance for the tine to displace far enough for desired loudness. The magnetic field may also cause direct contact of the tine to the energized coil, thereby producing a displeasingly audible "clicking" sound.

Bearing these considerations in mind, it has been discovered that demands on hardware, e.g., actuator sizes, and drivers, etc., and power supply capacity, can be minimized with knowledge of the resonant frequency of each tine. Moreover, the precision demands of the system are considerably reduced. In particular, corresponding coils can be placed relatively close to the tines and intermittently energized at precise frequencies and duty cycles to move the tines and generate traditional music box tones. The presently preferred distance (a) between a coil and its respective tine as shown in FIG. 3 is approximately 0.040". The resonant frequency of each tine is either well known and can be provided by the comb manufacturer, or can be easily measured. With this information, a coil 16 can be energized in an efficient manner by providing a periodic series of current pulses to incrementally add energy to the corresponding tine as the tine vibrates without requiring physical contact with the tine, thereby bringing about an even greater final displacement than might otherwise be practical from applying a single relatively large current pulse to the coil. For reasons explained below, fewer activation pulses provide the best results to approximate the sound of a mechanically-actuated tine (i.e. a tine that is physically struck by an actuator pin).

Figure 5:
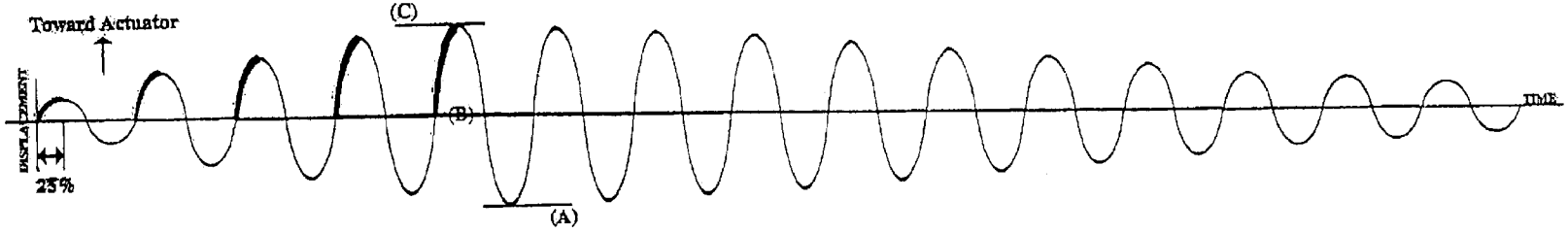
FIG. 5 shows a motion curve of a tine energized in accordance with the present invention.

With reference now to FIG. 5, a graph representing the movement of a tine as it is energized to produce a musical tone in accordance with a preferred embodiment of the present invention is shown. The vertical axis of FIG. 5 represents the tine displacement relative to an actuating coil. The horizontal axis shows the time a particular tine is vibrating. The first five periods of tine vibration show a part of the curve in "bold" indicating the energizing occurrence of the actuator. In other words, the actuator is energized as the tine moves from position (B) toward the actuator, at which point the actuator is no longer energized. Thus, in the depiction of FIG. 5 energy is added only during the first 25% of each resonant period of the tine being excited.

With continued reference to FIG. 5, when actuation of a tine commences, the tine begins at its rest (position (B)) and then, when magnetically actuated, is displaced toward the actuator during the first 25% of the period of the tine resonant frequency. After that, the tine begins to move away from the actuator as part of its natural resonant behavior. As the tine approaches the actuator again, the magnetic field increases at a rate proportional to the inverse of the cube of the distance between the tine and actuator. Energizing the actuator when the tine is farther away than the neutral position (position (B)) is an inefficient use of power because of the inverse cube law, i.e., the magnetic influence on the tine would be more or less significant depending on the relative position between the tine and the actuator.

Once the tine is set in motion, the coil need not be energized for the full 25% period duration in order to incrementally increase energy in the tine. For example, the coil could be energized after the tine passes position (B) in the direction of the coil, as opposed to immediately as the tine reaches position (B) on the was toward the coil. In order to produce a desired conventional music box tone, the coil should be shut-off at the point that the tine starts to move in a direction away from the coil (i.e. from (C) to (B)). Initially, of course, coil activation will occur when the tine is in position (B) because that is its initial rest position. Once the tine is in motion, each time it approaches the actuator, the inverse cube rule yields much greater efficiency of energy transfer.

By incrementally adding energy to a moving tine over relatively few periods (e.g., five periods, etc.) a tone or note having a desired loudness is generated. The loudness of the generated note can be increased or decreased by energizing over more or less periods, respectively, thus producing "accent" notes when a melody is played from a sequence of generated notes. In other words, the loudness of the generated note is dictated by the amount of energizing time for the corresponding tine. Thus, for a tine having a frequency of 1 kHz, five periodically-delivered excitation pulses will take less than 5 ms—an instantaneous time to the human ear. Accordingly, as a result of the quick response time, additional pulses can be added without any audible delay time. Also, by de-energizing the coil as the tine moves away from the coil, and then energizing the coil when the tine is sufficiently close to the coil to maximize magnetic attraction there between, (e.g., in accordance with the 25% duty cycle depicted in FIG. 5), a customary mechanical music box tone is generated wherein a physically "plucked" tine sound will be produced without requiring physical contact between a tine 15 and its associated or corresponding actuator coil 16.

It will be appreciated that the number of pulses and the coil duty cycle can be readily varied as dictated by the sizes and resonant frequencies of the tines as well as by the parameters of the actuator coils and the distances between the coils and the tines. It should also be appreciated that various sound effects can be produced by varying the timing and duration of the coil activation pulses relative to the tine resonant frequencies. For example, the coils could be energized for up to a 50% duty cycle synchronized to occur as a tine moves from position (A) to position (C). Any other synchronized duty cycle will correspond to movement of the tine away from the coil and will be counterproductive to the vibrating motion of the tine.

The reason for the use of a smaller amount of excitation pulses rather than a larger amount is because, with the addition of each pulse and as energy accumulates, time passes. If, as is possible, numerous lower energy pulses are applied (e.g., 20 pulses at 12.5% duty cycle, etc.), the time of excitation is extended to the point that the attack of the note becomes soft and lacking in the characteristic music box crispness. The generated sound approaches the soft bowing of a violin rather than the "plink" of a music box. This effect can be attractive in certain applications and is intended as yet another feature of this invention.

Another reason to employ a minimum amount of excitation pulses to the coils has to do with the inevitable tuning disparity, even if slight, between the frequency of the excitation pulses used to energize the coils and the resonant frequency of the tines. As an example, if the period difference between excitation pulses and a tine resonant frequency is a mere 1%, then over a series of fifty excitation pulses, an error of 50% accumulates. At this point, instead of continuing to excite the tine, energy is removed as a result of phase cancellation. Using only a few pulses, however, precision is less critical, while still maintaining the advantages of resonant addition of energy. Also, with knowledge of the period difference between the tine frequency and the coil activation pulses, such information can be programmed into the controller 18 to provide more precise stimulation of the tines to produce varying effects such as a "tremolo" effect.

Figure 9:
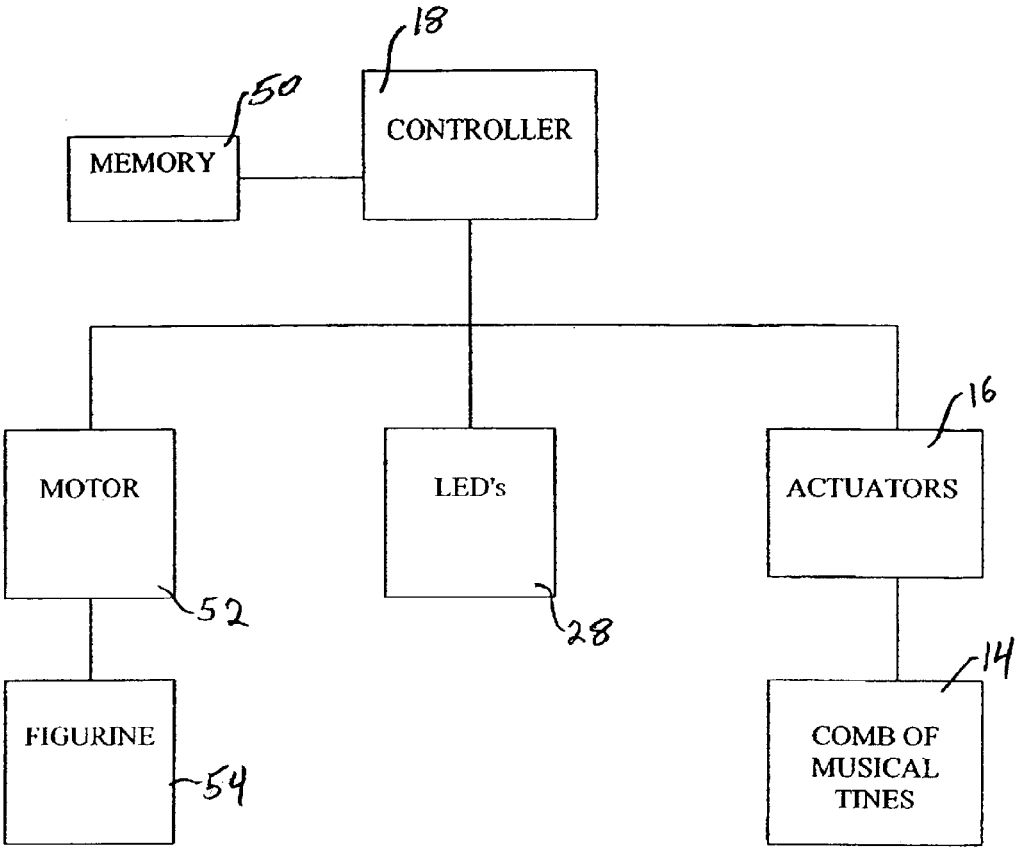
FIG. 9 depicts a block diagram of the primary components of the present invention.

With reference to FIG. 9, a block diagram of the components of the electronic music engine 10 includes the controller 18 which receives, from a memory 50, data or instructions as to which actuators 16 to address and how they are to be addressed, i.e., the order, frequency and number of pulses, etc. The actuators 16 are used, as explained above, to energize individual tines 15 on a comb 14. An output signal from the controller is also used to address and illuminate select LED's 28. The output signal can also operate a motor 112 for driving a figurine or other movable member 114 to simulate, for example, a rotating ballerina as is common with certain mechanical music boxes. Thus, because all of these functions operate from a common clock signal, as explained below, the various functions are synchronized with the generated music to create a visually and audibly pleasing device.

Figure 10A:
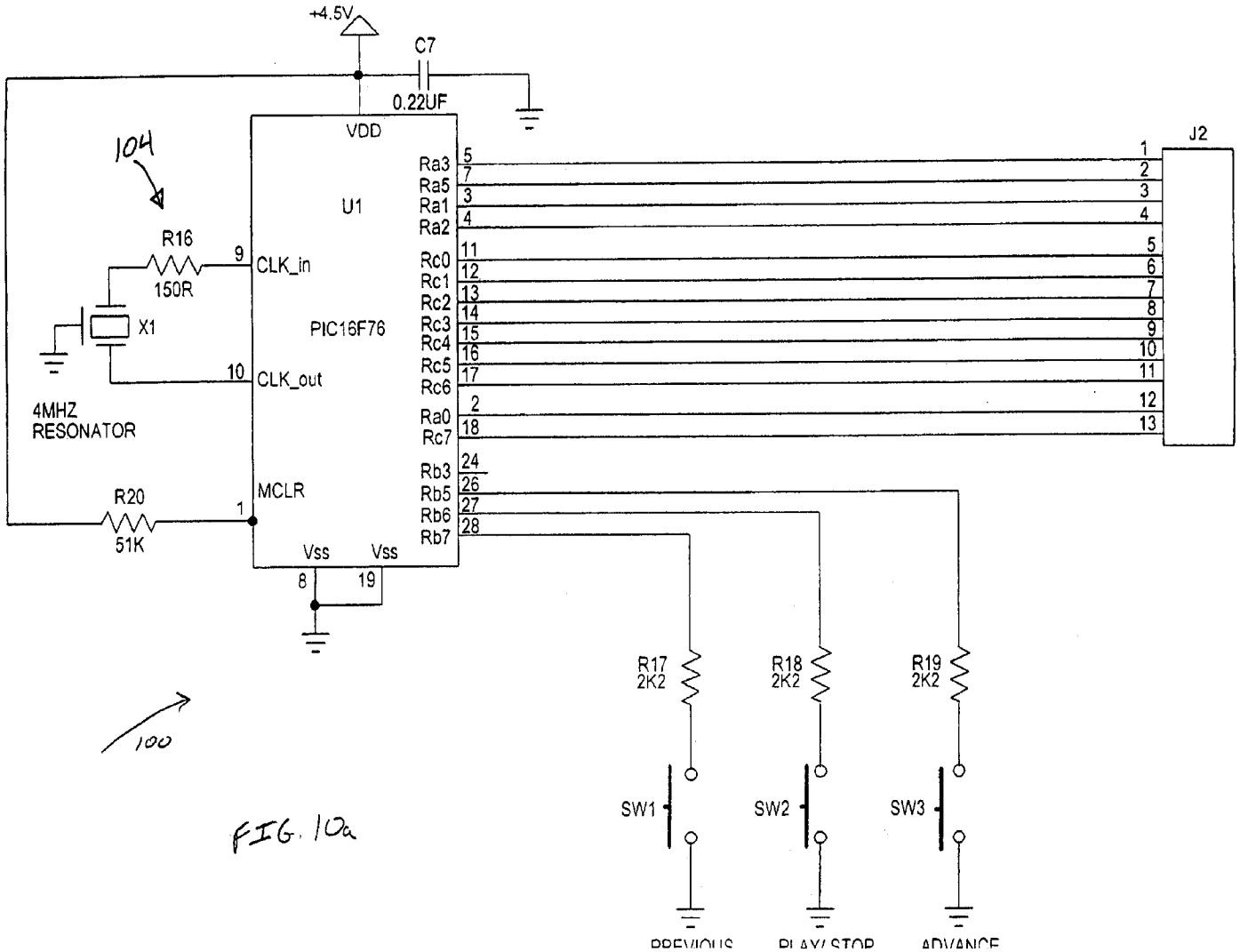
FIGS. 10*a*–10*b* depict schematic representations of a preferred control circuit of the device.
Figure 10B:
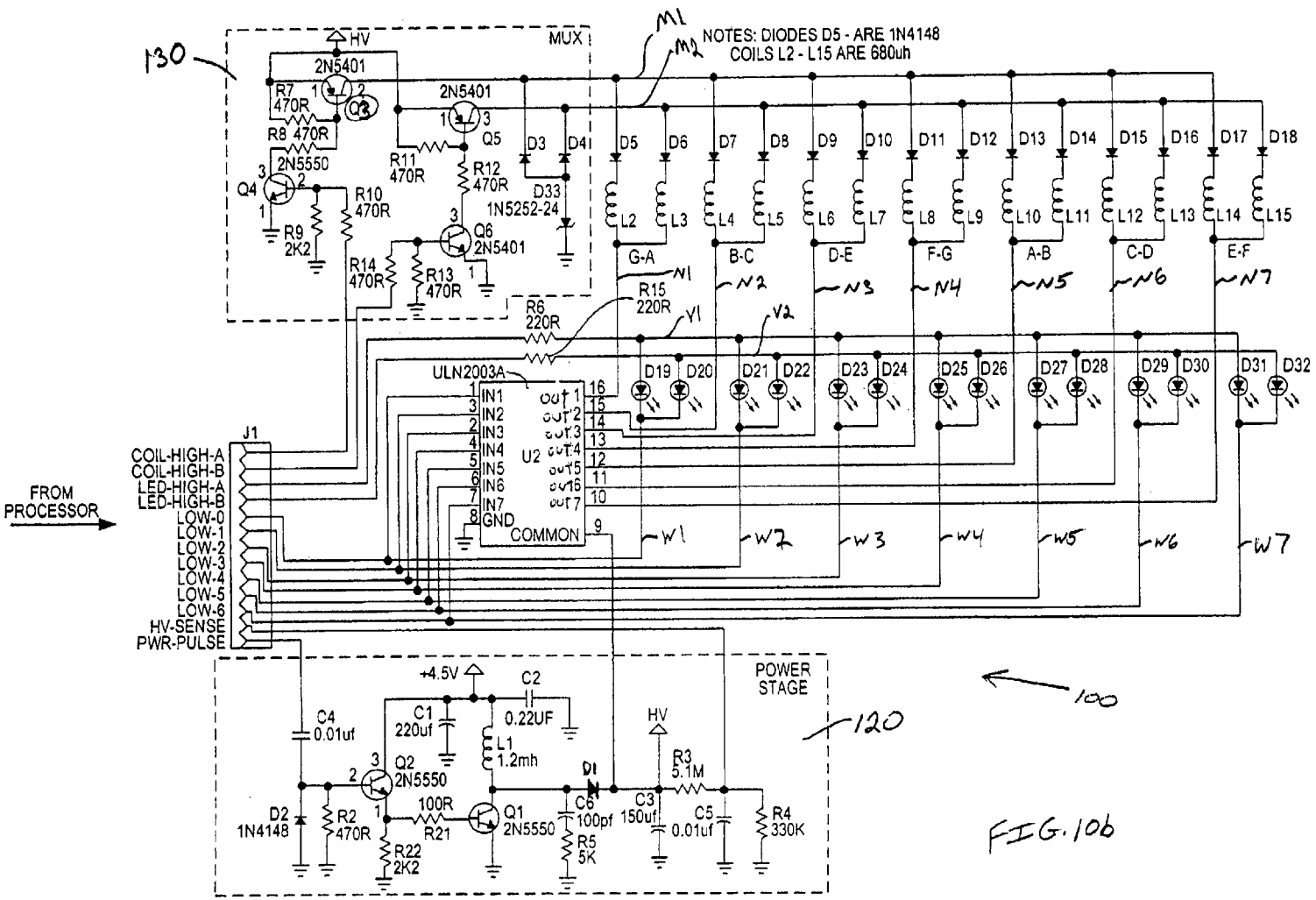

With reference also to FIGS. 10*a* and 10*b*, the controller 18 and, specifically the circuit board 19 includes a circuit 100 having a processor U1 which accesses data stored in memory 50 for playing one of a plurality of melodies or songs. It will be appreciated that memory 50 may be integral with or separate from processor U1. In particular, the data is used to energize (e.g. provide current pulses to) one or more coils 16 at any given time at a rate approximating the resonant frequency of each tine 15 associated with each coil 16. The table below lists the tine resonant frequencies, the coil energizing frequencies and the corresponding musical notes.

| Tine # | Selected Tine Lowest-Highest | Tine Note | Tine (f) Hz | Coil (f) Hz |
|---|---|---|---|---|
| 1 | — | — | — | No Coil |
| 2 | — | — | — | No Coil |
| 3 | — | — | — | No Coil |
| 4 | — | — | — | No Coil |
| 5 | 1 | G | 392 | 392 |
| 6 | 2 | A | 440 | 440 |
| 7 | 3 | B | 493.88 | 494 |
| 8 | 4 | C | 523.25 | 523 |
| 9 | 5 | D | 587.33 | 587 |
| 10 | 6 | E | 659.26 | 659 |
| 11 | 7 | F | 698.46 | 698 |
| 12 | 8 | G | 783.99 | 784 |
| 13 | 9 | A | 880 | 880 |
| 14 | 10 | B | 987.77 | 988 |
| 15 | 11 | C | 1046.5 | 1047 |
| 16 | 12 | D | 1174.66 | 1175 |
| 17 | 13 | E | 1318.51 | 1319 |
| 18 | 14 | F | 1396.91 | 1397 |
| 19 | — | — | — | No Coil |
| 20 | — | — | — | No Coil |

The processor U1 is activated by the user controls SW1, SW2 and SW3, which provide "previous song", "play/stop", and "advance song" options, respectively. A clock stage 104 synchronizes the circuit components to a reference clock, in a manner well known to those of ordinary skill, and a power stage 120 generates operating power from a power source. For the preferred actuators, a driving voltage of between 35 v to 50 v is required. To generate this voltage, power stage 120 is configured as a switching voltage power supply which is intelligently controlled by the processor U1. During non-actuator pulse generating periods, voltage pulses are supplied by the processor U1 to the power stage 120 to charge capacitor C3 to within the driving voltage range. A high voltage feedback input ("HV-SENSE") on the processor U1 senses when the driving voltage has been achieved and then discontinues the supply voltage pulses to the power stage until they are subsequently required. The power source can consist of a single or multiple batteries 22, three AA batteries are used in the presently preferred embodiment to generate 4.5V. If lights or motors are added, additional current may be required, suggesting either greater capacity batteries or an AC adaptor for plug-in use. The average current consumption for the 4.5 volt batteries is likely to be approximately 5 milliamps. This is very low power as compared with known motor-driven music boxes, which might use 100 mA or more.

By selecting the play/stop switch SW2, data corresponding to a selected melody is retrieved from memory in, or accessible by, processor U1 and output to one or more of pins 1–13 on a jumper connector J2. Jumper connector J1 receives the data from connector J2 and provides it to a plurality of coils 16 and LED's 28. The data includes address signals to selectively energize specific coils in order to play corresponding notes comprising a melody or one of a plurality of melodies. As shown, fourteen coils L2–L15 are provided, with each coil corresponding to a tine 15 on the comb 14 for playing any of the fourteen separate notes. Fourteen LED's are also provided (D19–D32), with each LED 28 associated with a single one of the coils 16.

The coils 16 are arranged in pairs as L2-L3 (notes G-A), L4-L5 (notes B-C), L6-L7 (notes D-E), L8-L9 (notes F-G), L10-L11 (notes A-B), L12-L13 (notes C-D) and L14-L15 (notes E-F). An open-collector current driver IC U2 receives control signals from jumper pins 6–12 and provides outputs to address terminals N1–N7 and to each coil pair via output pins 10–16 of IC U2. The other terminal of each coil 16 is connected to a respective isolation diode D5–D18, which is, in turn, connected to one of two high voltage lines M1, M2 of a high voltage driver stage 130. One of the high voltage lines (M1) outputs a signal from a PNP-NPN transistor pair Q3, Q4 and, in particular, from the collector terminal of transistor Q3. The base terminal of transistor Q3 is connected to the collector terminal of transistor Q4 and the base terminal of transistor Q4 receives a control signal from processor U1 via pin 1 of jumper connector J1. Likewise, the second high voltage line (M2) outputs a signal from a second PNP-NPN transistor pair Q5, Q6 connected to each other in an identical manner as transistor pair Q3, Q4, but operable from a signal present at pin 2 of jumper connector J1. The LED's are also grouped in pairs as D19-D20, D21-D22, D23-D24, D25-D26, D27-D28, D29-D30, and D31-D32. One terminal of each LED is connected to one of two LED lines V1, V2 at pins 2, 3, respectively of jumper connector J1. The other, terminal of each LED pair is connected to a respective address line W1–W7 connected to jumper pins 6–12 of jumper connector J1, respectively.

When activated, the circuit operates as follows: If a selected pre-stored melody requires the generation of a low "G" note, coil L2 will need to be energized. This is accomplished by the processor U1 generating a logic "one" or "high" signal on jumper pin 1. This signal causes transistors Q3 and Q4 to turn on which pulls high voltage line M1 to a high voltage presented at one of the terminals of each diode D5, D7, D9, D11, D13 and D15. Simultaneously, a low signal will be generated by the processor U1 on output terminal 6. This signal will be applied to IC U2 which will output a low signal at U2 pin 16 for addressing the address line N1 of coil pair L2, L3 and causing a potential difference across coil L2. Since the note activation occurs so quickly (e.g., 4.2 ms for a 1 kHz frequency), a sequence of notes can be generated which will yield a perception to a human ear that the notes are played simultaneously. This allows the device to be used to play "chords" or other multiple notes.

As explained above, the current flowing through coil L2 generates a magnetic field for attracting a corresponding tine in close proximity to coil L2 for generating a "G" note. The low signal at U2 pin 16 is preferably generated as a series of short pulses (e.g. five pluses at 25% duty cycle) having a frequency proximate the resonant frequency of the selected tine to efficiently impart movement to the tine and produce a "plucked" tine sound resembling that of a tine being "plucked" through physical contact with a pin or other structure. In the preferred embodiment the series of pulses is administered to one or more of the address lines N1–N7 while the required high voltage line line M1 and/or M2 remains at a "high" value during the entire duration of the pulse series.

In addition to sound generation, the controller 102 and, in particular, the circuit 100 will control the illumination of the LED's D19–D32 by generating appropriate address signals on LED lines V1, V2 and LED address lines W1–W7. In the preferred embodiment, a separate LED corresponds to each of the fourteen coils, which in turn corresponds to each of the fourteen selectable musical notes. Thus, when a particular coil is activated to generate a corresponding note, the LED associated with that coil is illuminated to create a pleasing visual effect to the user of the device. To accomplish this, when a "high" signal is present on pin 1 of jumper connector J1 to activate high voltage line M1, a "high" signal is also present at pin 2 of a jumper connector J1 to activate LED line V1. As shown in FIG. 10*b*, the signal present at pins 5–12 of jumper connector J1 is applied to LED address lines W1–W7 and also to address IC U2 input pins 1–7. The address IC U2 controls the addressing of the coil pairs and also simultaneously activates one or more corresponding LED's. For example, when lines M1 and V1 are "high", a "low" value at pin 5 of jumper connector J1 will be applied to coil address line N1 for energizing coil L2 and will also be applied to LED address line W1 for illuminating LED D19.

As has now been explained, the control circuit 100 allows for the sequential and/or simultaneous activation of the coils and LED's in accordance with a control signal produced by the microprocessor U1 to play a plurality of melodies. It will also be readily appreciated that the control circuit 100 is easily scalable to include additional coils 16 and/or additional LED's 28. For example, by adding a third PNP-NPN transistor pair to the high voltage driver stage 130 with additional address lines (N), the number of coils can be increased beyond fourteen so that additional tines can be energized and additional notes can be played. The microprocessor U1 may be user-programmable or configured for interfacing with an auxiliary memory or data source to increase or replace song data as desired. For example, additional songs may be made available to the user for uploading into memory in the microprocessor U1 in order to expand and/or replace the available song selection. Such additional song data may be made available through the use of expansion memory chips or modules sold or otherwise provided to consumers and/or by accessing song data via, for example, the internet, for storage in microprocessor memory or in memory accessible by the microprocessor. Such modifications are contemplated as features of the present invention.

It is also pointed out that by using the clock stage 110 to synchronize the functions performed by the control circuit 100, the sound generation and illumination functions performed by the coils and LED's occur virtually simultaneously. This enhances the user enjoyment of the device. Moreover, the clock signal from the clock stage 110 can also be used to synchronize operation of a motor or solenoid for driving a figurine or other member mounted to the housing, as is commonly associated with music boxes, to import, for example, rotation motion for simulating "dancing" of the figurine, etc. The clock signal can also be used to synchronize the operation of additional lights (not shown), which may be mounted to the outer housing 38 or elsewhere.

Figure 6B:
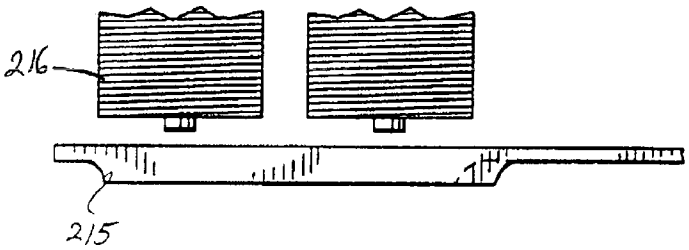
FIGS. 6*a*–6*b* depict plan and cross-sectional views, respectively, of one alternative arrangement of the tine comb and magnetic actuators.
Figure 7B:
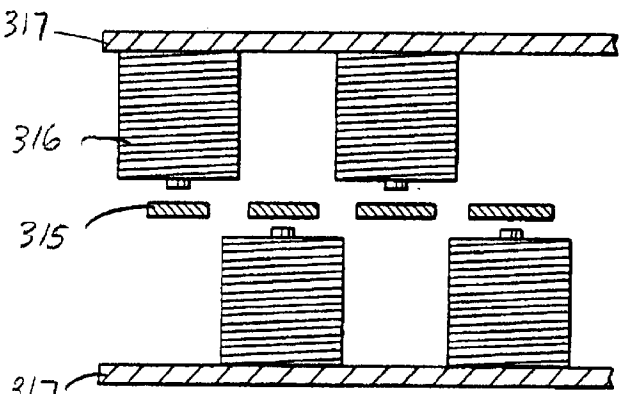
FIGS. 7*a*–7*b* depict plan and cross-sectional views, respectively, of another alternative arrangement of the tine comb and magnetic actuators.
Figure 6A:
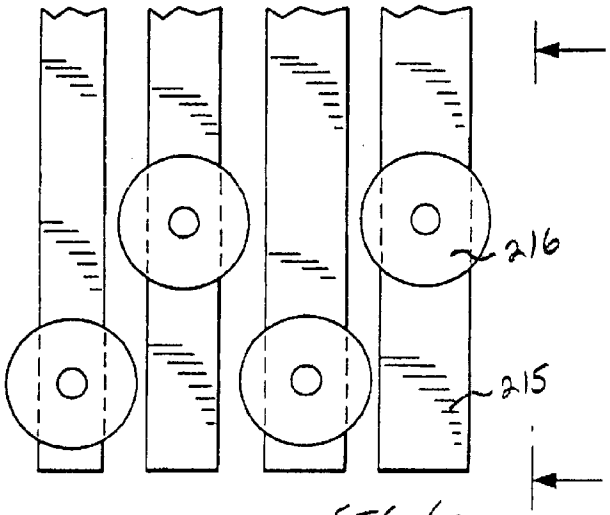
Figure 7A:
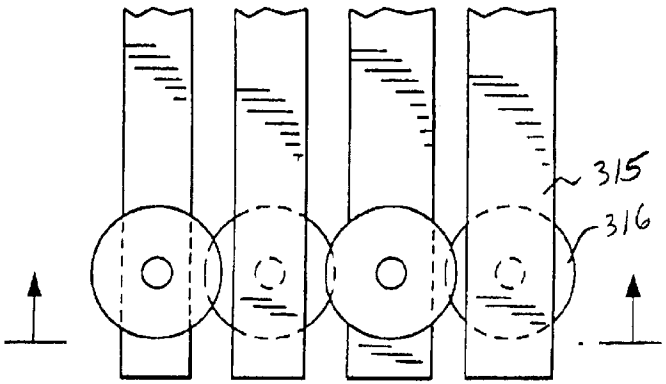

Referring now to FIGS. 6*a* and 6*b*, alternative arrangements of the coils 216 relative to the tines 215 are shown. Although relatively small, the size constraints of the coils may prevent a side-by-side coil arrangement for use with smaller and smaller combs. In particular, as the pitch between adjacent tines is reduced on combs of smaller size, physical limitations will prevent the use of a single row of coils to activate the individual tines. Accordingly, and as shown in FIG. 6*a*, the coils 216 can be staggered along a common (e.g. upper or lower) surface of the tines 215 to accommodate space constraints. Alternatively, and as depicted in FIGS. 7*a* and 7*b*, the coils 316 can be staggered to oppose both surfaces of the tines such that a first coil will be positioned on an upper surface of its corresponding tine, a second coil will be positioned at the lower surface of the adjacent tine, the next coil positioned at the upper surface of an adjacent tine, etc. This "stacked" coil configuration requires an upper and lower mounting plate 317 and alleviates space constraints when smaller and smaller combs are employed.

Figure 8B:
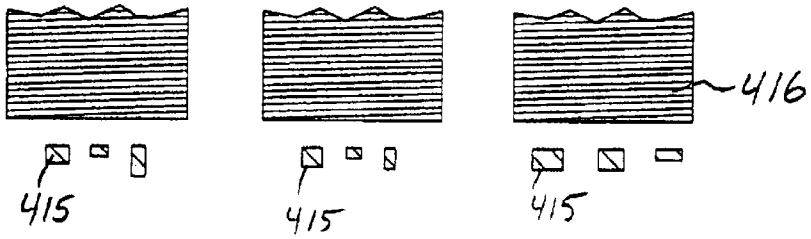
FIGS. 8*a*–8*b* depict plan and cross-sectional views, respectively, of an alternative tine comb configuration.
Figure 8A:
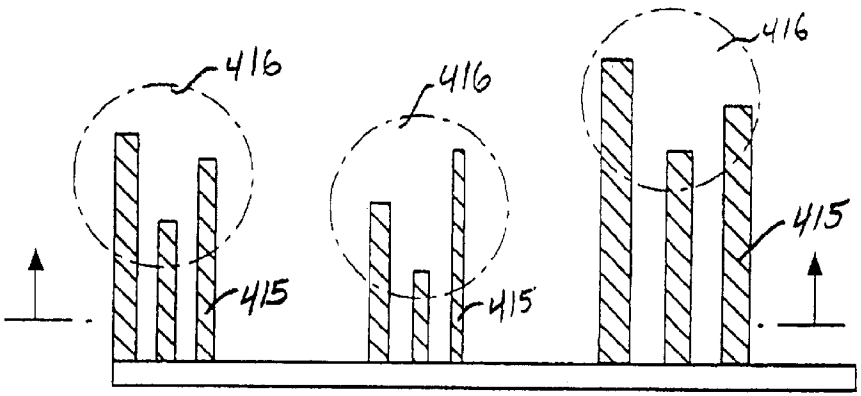

As stated above, a one-to-one ratio between the coils and tines is preferred. However, alternative arrangements of the coils and tines can be employed such that, for example, a coil can be used to energize multiple tines as shown in FIGS. 8*a* and 8*b*. In such an embodiment, however, the notes of the comb are arranged in an out-of-scale order so that highly disharmonic notes are placed adjacent to each other, preferably in groups. Three groups of tines, each containing three tines 415 of disharmonic notes, are shown. This arrangement permits a single coil 416 to be used for each group because the frequency of the coil excitation signal for exciting one of the tines in a group will not significantly affect the other tines of the group as a result of the disparate points of resonance. In other words, the tines in each group are frequency-separated from each other to limit the potential for cross-talk.

As should be readily appreciated from the foregoing, the present invention provides a realistic "mechanical" music box effect while also providing for enhanced features and operations. For example, a song length is no longer dictated by the mechanical constraints of a pin cylinder or disk. Thus, a song can be any length and limited only by the constraints of the microprocessor U1. A variety of songs can also be presented, with the ability to stop any song at any given time and then start that song from the beginning, almost instantaneously. Musical accents or "dynamics" can also be employed in the playing of various songs by simply increasing the number of excitation pulses applied to particular coils and the frequency and duty cycle of the pulse pattern. Different sound effects can also be readily generated such as, for example, producing a tremolo effect by reducing the duty cycle of the coil actuation and injecting frequency cycle error or by increasing the number of excitation pulses applied to the coils.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. In particular, the circuit 100 is only one example of an operation circuit that can be employed in the present invention. It is the intention, therefore, to be limited only as indicated by the scope of the claims appended hereto.

What is claimed is:

1. An electronic engine for generating acoustic musical notes, comprising:

a memory containing data;

an electronic controller connected to said memory and producing a control signal in accordance with said data;

a plurality of tone generating members formed as a comb of adjacently-separated tines, with each said tine capable of generating a corresponding musical note upon imparting motion to respective ones of said tines; and an actuator in communication with said controller for generating, in response to said control signal, a temporary magnetic field, said actuator positioned sufficiently close to said at least one of said tines to attract or repel said at least one tine without causing physical contact between said at least one tine and said actuator at the commencement of the attraction or repulsion, whereby a vibrating motion is caused in said at least one tine to produce said corresponding musical note.

2. The electronic engine of claim 1, wherein the individual musical notes comprise a diatonic scale of musical notes.

3. The electronic engine of claim 1, wherein said actuator comprises a plurality of actuators, with each actuator corresponding to at least one of said tines.

4. The electronic engine of claim 3, wherein said data comprises information for energizing specific ones of said actuators in said plurality of actuators for producing musical notes from said tines according to a sequence defined by said information, thereby causing a melody to be played from said individual musical notes.

5. The electronic engine of claim 4, wherein said data comprises a plurality of melodies.

6. The electronic engine of claim 3, wherein each said tine has a resonant frequency, said data comprising address signals for activating specific ones of said actuators in said plurality of actuators according to a series of activation pulses having a frequency proximate the resonant frequency of said corresponding tine.

7. The electronic engine of claim 7, wherein said activation pulses for each actuator have a duty cycle not more than fifty percent of the resonant frequency of each corresponding tine.

8. The electronic engine of claim 3, wherein each tine has a free end and wherein said plurality of actuators are positioned at said free ends.

9. The electronic engine of claim 3, wherein each tine has a free end and wherein said actuators are positioned in a staggered arrangement relative to said free ends.

10. The electronic engine of claim 3, wherein each tine has a top surface and a bottom surface and wherein some of said actuators are positioned opposing said top surfaces and others of said actuators are positioned opposing said bottom surfaces.

11. The electronic engine of claim 3, further comprising a plurality of lights, with each light corresponding to one of said actuators, said lights being selectively operable in response to said control signal.

12. The electronic engine of claim 3, wherein said electronic controller is used to control one or more of a motor, light and solenoid.

13. The electronic engine of claim 3, further comprising a base plate mounted to said comb.

14. The electronic engine of claim 13, further comprising a housing mounted to said base plate.

15. An electronic music engine for producing acoustic musical notes, comprising:

a comb having a plurality of tines containing ferrous material and tuned to a plurality of notes, each tine producing a select note upon imparting movement to one of said tines corresponding to said select note;

a plurality of actuators operating between a magnetized state and an unmagnetized state, said actuators positioned at a location relative to said comb for generating one of an attraction force and a repulsion force directed at said tines when said actuators are in said magnetized state, without requiring physical contact between said actuators and said tines; and an electronic controller connected to said plurality of actuators, said electronic controller generating a control signal for energizing specific ones of said actuators according to a predetermined sequence to cause said energized specific actuators to impart movement to tines influenced by said magnetized state of said energized specific actuators, whereby said musical notes associated with said moving tines are produced.

16. The electronic engine of claim 15, wherein movement is imparted to said tines by said attraction force.

17. The electronic engine of claim 16, wherein each tine has a resonant frequency and wherein said control signal energizes said specific ones of said actuators by resonantly adding energy thereto.

18. The electronic engine of claim 16, wherein said control signal comprises data corresponding to a plurality of melodies.

19. The electronic engine of claim 17, wherein the activation pulses in said series of activation pulses have a duty cycle of not more than fifty percent of the resonant frequency of said influenced tine.

20. The electronic engine of claim 16, wherein each tine has a free end and wherein said plurality of actuators are positioned at said free ends.

21. The electronic engine of claim 16, wherein each tine has a free end and wherein said actuators are positioned in a staggered arrangement relative to said free ends.

22. The electronic engine of claim 16, wherein each tine has a top surface and a bottom surface and wherein some of said actuators are positioned opposing said top surfaces and others of said actuators are positioned opposing said bottom surfaces.

23. The electronic engine of claim 16, further comprising a plurality of lights, with each light corresponding to one of said actuators, said lights being selectively operable in response to said control signal.

24. The electronic engine of claim 16, further comprising a motor responsive to said electronic controller for imparting motion to a decorative member.

25. The electronic engine of claim 16, further comprising a base plate mounted to said comb.

26. The electronic engine of claim 16, further comprising a housing mounted to said base plate.

27. An electronic engine for generating acoustic musical notes, comprising:

a memory containing data;

an electronic controller connected to said memory and producing a control signal in accordance with said data;

a plurality of tone generating members comprising a comb of adjacently-separated tines, with each tine capable of generating a corresponding musical note upon imparting motion thereto; and actuating means for generating, in response to said control signal, a magnetic field, said actuating means causing one of an attraction force and a repulsion force from said temporary magnetic field to be directed at one of said tone generating members to respectively attract or repel said tone generating members without requiring physical contact between said tone generating member and said actuating means, whereby a vibrating motion is caused in said tone generating member to produce said corresponding musical note.

28. The electronic engine of claim 27, wherein said actuating means comprises a plurality of actuating coils.

29. The electronic engine of claim 27, further comprising a plurality of illumination sources and an illumination control means for selectively energizing the illumination sources.

30. The electronic engine of claim 29, wherein said illumination control means is operable from said control signal.

31. The electronic engine of claim 30, wherein said control signal synchronizes said illumination control means to said actuator means.

32. The electronic engine of claim 27, wherein said actuating means comprises a plurality of actuating coils.

33. The electronic engine of claim 27, wherein each tone generating member has an associated resonant frequency and wherein said control signal energizes said specific ones of said actuating coils by resonantly adding energy thereto.

34. A method of generating acoustic musical notes, comprising the steps of:

producing a control signal representative of a musical melody;

providing a plurality of tone generating members, each said member generating a corresponding musical note upon imparting motion to said one tone generating member wherein each tone generating member in said plurality of tone generating members comprises a tine on a comb;

placing an actuator at a distance from said plurality of tone generating members; and generating in said actuator, and in response to said control signal, a temporary magnetic field of sufficient strength to attract or repel at least one of said tone generating members according to a predetermined sequence as dictated by said control signal, without requiring physical contact between said at least one tone generating member and said actuator, whereby a vibrating motion is caused in said tone generating members to produce said corresponding musical note.

35. The method of claim 34, wherein each tine has an associated resonant frequency and wherein said generating step further comprises generating the temporary magnetic field by applying a series of activation pulses to said actuator at a frequency proximate the resonant frequency of at least one of said tines.

36. The method of claim 35, wherein the activation pulses in said series of activation pulses have a duty cycle of not more than fifty percent of the resonant frequency of said at least one tine.

* * * * *